US009704466B2

(12) United States Patent
Uetabira

(10) Patent No.: US 9,704,466 B2
(45) Date of Patent: Jul. 11, 2017

(54) SOUND CONTROL APPARATUS

(71) Applicant: INTERMAN Corporation, Kagoshima (JP)

(72) Inventor: Shigeki Uetabira, Kagoshima (JP)

(73) Assignee: INTERMAN Corporation, Kagoshima (JP)

( * ) Notice: Subject to any disclaimer, the term of this patent is extended or adjusted under 35 U.S.C. 154(b) by 248 days.

(21) Appl. No.: 14/444,258

(22) Filed: Jul. 28, 2014

(65) Prior Publication Data

US 2015/0034413 A1 Feb. 5, 2015

(30) Foreign Application Priority Data

Aug. 2, 2013 (JP) ..... P2013-161774

(51) Int. Cl.

| | |
|---|---|
| ***H04R 1/28*** | (2006.01) |
| ***H04R 1/22*** | (2006.01) |
| ***G10K 11/00*** | (2006.01) |
| ***G10K 11/168*** | (2006.01) |
| ***H04R 1/34*** | (2006.01) |
| *H04R 1/02* | (2006.01) |

(52) U.S. Cl.

CPC ..... *G10K 11/004* (2013.01); *G10K 11/168* (2013.01); *H04R 1/345* (2013.01); *H04R 1/026* (2013.01)

(58) Field of Classification Search

CPC .... H04R 1/2869; H04R 1/2876; H04R 1/026; H04R 1/2803; H04R 1/2811; H04R 1/2873; H04R 1/288; G10K 11/004; G10K 11/168

USPC ..... 181/286, 150, 146, 151, 199, 287, 290; 381/345, 353, 354

See application file for complete search history.

(56) References Cited

U.S. PATENT DOCUMENTS

| | | | | |
|---|---|---|---|---|
| 2,552,309 A * | 5/1951 | Carlson | H04R 1/021 181/141 |
| 3,443,661 A * | 5/1969 | Van Sciver | H04B 1/086 181/199 |
| 4,493,471 A * | 1/1985 | McInnis | F16F 1/376 181/208 |
| 5,138,656 A * | 8/1992 | Shanes | H04M 9/08 379/167.11 |
| 5,197,707 A * | 3/1993 | Kohan | H04R 1/026 248/562 |
| 5,333,204 A * | 7/1994 | Hamada | H04R 1/2826 181/151 |

(Continued)

FOREIGN PATENT DOCUMENTS

| | | | |
|---|---|---|---|
| JP | 07-129182 A | 5/1995 | |
| JP | WO 2012137353 A1 * | 10/2012 | G10K 11/168 |

*Primary Examiner* — Edgardo San Martin

(74) *Attorney, Agent, or Firm* — Maier & Maier, PLLC

(57) ABSTRACT

A sound control apparatus capable of improving the quality of the reproduction sound output from an electronic apparatus includes a sound control mat, and a support unit for supporting an electronic device having a speaker on the sound control mat. The sound control mat has a sound controlling structure configured to control the resonance of sound output from the speaker of the electronic apparatus when it is supported by the sound control mat. With this sound control apparatus, it is possible to enjoy a good tone directly output from a television, a stereo system or any other device having a small speaker without needing a special devising.

15 Claims, 16 Drawing Sheets

(56) References Cited

U.S. PATENT DOCUMENTS 5,360,108 A * 11/1994 Alagia ..... H01H 9/0242 206/320
5,929,395 A * 7/1999 Bizlewicz ..... F16F 1/40 181/207
6,012,542 A * 1/2000 Accordino ..... H04R 1/2811 181/152
6,342,287 B1 * 1/2002 Kaczmarek ..... E01B 9/68 238/283
6,845,841 B2 * 1/2005 Smith ..... F16F 15/08 181/207
7,325,649 B1 * 2/2008 Budge ..... H04R 1/288 181/146
D563,431 S * 3/2008 Entner ..... D14/217
D605,188 S * 12/2009 Martinez ..... D14/253
7,668,309 B2 * 2/2010 Wilcox ..... B60R 11/0241 379/454
7,778,431 B2 * 8/2010 Feng ..... H04M 1/04 381/160
7,991,181 B2 * 8/2011 Saiki ..... H04R 1/2803 381/353
8,387,790 B2 * 3/2013 Conner ..... A45C 11/00 206/320
8,428,284 B2 * 4/2013 Meyer ..... H04R 1/347 181/155
8,522,917 B1 * 9/2013 Oh ..... G10K 11/08 181/148
8,807,267 B2 * 8/2014 Iwata ..... H04R 1/28 181/148
8,857,559 B2 * 10/2014 Reviel ..... H04R 1/26 181/146
8,885,338 B1 * 11/2014 Simpson ..... A45F 5/10 224/929
9,027,705 B2 * 5/2015 Furusawa ..... G10K 11/168 181/290
9,258,397 B2 * 2/2016 Lee ..... H04M 1/035
2001/0039200 A1 * 11/2001 Azima ..... H04M 1/04 455/575.1
2002/0162937 A1 * 11/2002 Sebert ..... H04R 1/026 248/618
2007/0102612 A1 * 5/2007 Seil ..... B60R 11/00 248/311.2
2007/0151899 A1 * 7/2007 Chun ..... B65D 25/10 206/775
2008/0240482 A1 * 10/2008 Haddad ..... H04R 1/2807 381/337
2013/0032432 A1 * 2/2013 Slotta ..... H05K 5/02 181/199
2015/0041244 A1 * 2/2015 Kam ..... A45C 11/00 181/191
2015/0122575 A1 * 5/2015 Park ..... H04R 1/2811 181/182

* cited by examiner

SOUND CONTROL APPARATUS

CROSS-REFERENCE TO RELATED APPLICATIONS

The present application claims priority under 35 U.S.C. §119 to Japanese Patent Application No. P2013-161774, filed on Aug. 2, 2013. The contents of this application are herein incorporated by reference in their entirety.

BACKGROUND OF THE INVENTION

Field of Invention

The present invention relates to a sound control apparatus which can improve the quality of reproduction sound when playing music or movies.

Smartphones have in recent years become more prevalent with rapidly-advancing performance and can be used independently for a variety of purposes. The performance of the built-in speaker of a smartphone is still increased, so that users often listen to music directly from the built-in speaker. Also, some type of smartphone is provided with stereophonic speakers for enjoying music without a headphone. It is thereby becoming possible to freely enjoy music anywhere in stereo.

On the other hand, for concert halls, theaters and the like, it is required to realize a high quality of sound environment by making throughout acoustical design with an optimal the overall geometrical configuration confined with walls, acoustical treatments of walls and so forth. Furthermore, even at an ordinary home, acoustical design may be considered to create a good sound environment, for example, in a home theater. For example, it is proposed to embed speakers in wall panels (Japanese Patent Published Application No. Hei 07-129182).

While the sound quality of a mobile terminal has been substantially improved, however, the high-pitched range tends to be unnaturally emphasized because the housing of such a mobile terminal is small so that the quality is not equal to that of usual speakers.

Furthermore, in an ordinary home, stereo and television systems are placed in arbitrary positions of a room without considering sound effects. Substantial expenses and time are required to realize various effective ideas for enjoying music in a better sound environment. Still further, unlike concert halls, the allowable size of a home theater is substantially limited so that there is room for elaborating the sound environment to improve the sound quality.

The present invention has been made in order to solve the problems as described above. It is an object of the present invention therefore to provide a sound control apparatus capable of improving the quality of the reproduction sound output from an electronic apparatus.

It is another object of the present invention to provide a sound control apparatus capable of improving the quality of sound recorded by an electronic apparatus.

It is a further object of the present invention to provide a sound control apparatus capable of inhibiting the influence of noise, which occurs during telephone conversation with the electronic apparatus, on telephone conversation.

It is a still further object of the present invention to provide a sound control apparatus capable of easily improving the quality of reproduction sound output from a stereo system or a television which is commonly used at an ordinary home with a low cost.

SUMMARY OF THE INVENTION

To achieve at least one of the abovementioned objects, a sound control apparatus reflecting one aspect of the present invention comprises: a sound control mat; and a support unit configured to support an electronic apparatus having a speaker on the sound control mat. The sound control mat has a sound controlling structure configured to control the resonance of sound output from the speaker of the electronic apparatus which is being supported by the sound control mat.

Preferably, in the invention as described above, the electronic apparatus is a wristwatch type terminal, a camera, a small size video recorder, a radio receiver, a digital music player, an IC recorders, or a projector.

Preferably, in the invention as described above, the sound control mat is made of at least one of needle felt, bestray, softray, glass wool, thermo wool, phenol resin, polyurethane, fibrous mineral wool, glass fiber and open-cell foam.

Preferably, in the invention as described above, the sound control mat is formed by joining a plurality of sound absorbing sheets together with an adhesive in the form of the laminate with an adhesive.

Preferably, in the invention as described above, the adhesive is a viscous adhesive which does not solidify after formation of the laminate, maintains its viscosity when the mobile terminal booth is used, and functions as the sound controlling member.

Preferably, in the invention as described above, the laminate is formed with a resin sheet interposed between each adjacent ones of the sound absorbing sheets.

Preferably, in the invention as described above, the resin sheet has a thickness of 0.1 mm to 0.5 mm.

Preferably, in the invention as described above, the resin sheet is provided with a plurality of openings, and wherein the sound absorbing layers are directly adhered to each other by the adhesive through the openings, and indirectly adhered to each other by the adhesive through the resin sheet.

Preferably, in the invention as described above, there is a spacing member configured to provide a space between the sound control mat and the electronic apparatus when the electronic apparatus is supported by the sound control mat.

Preferably, in the invention as described above, a plurality of suckers or suction pads are formed as the spacing member on a surface of the sound control mat.

Preferably, in the invention as described above, the sound control mat is shaped in a cylindrical form. The spacing member is provided as a number of rods which are projected upward from the surface of the sound control mat. The rods are longest at the center of the sound control mat and gradually become shorter toward the outer circumference of the sound control mat.

Preferably, in the invention as described above, the sound control mat and the electronic apparatus are spaced by a distance of 3 mm to 7 mm.

Preferably, in the invention as described above, there is a frame configured to cover the side surface of the laminate of the sound absorbing sheets.

Preferably, in the invention as described above, the frame is configured to cover only the side surface of the laminate of the sound absorbing sheets, and have the front and back surface of the laminate open to air.

Preferably, in the invention as described above, the support unit is a pocket which is fastened on the sound control mat in order to hold the electronic apparatus.

Preferably, in the invention as described above, the support unit is a belt having a hook-and-loop fastener.

Preferably, in the invention as described above, the support unit is a sponge layer which is formed on the surface of the sound control mat with an indent section having a smaller size than the electronic apparatus such that the electronic apparatus can be inserted in and supported by the indent section.

Preferably, in the invention as described above, there is a frame configured to cover the side surface of the sound control mat.

Preferably, in the invention as described above, the frame is provided with a bottom portion having substantially the same area as the sound control mat, and a spacer located on the bottom surface of the frame in order to form a space between the sound control mat and the bottom surface of the frame.

In accordance with another aspect of the present invention, a sound control apparatus is capable of controlling the resonance of sounds output from a speaker behind which the sound control apparatus is placed, said sound control apparatus, and comprises: a sound control mat; and a stand configured to support the sound control mat in an upright position. The size of the sound control mat is larger than the speaker in the horizontal direction when the sound control mat is placed behind the speaker. The sound control mat is made of a sound controlling material and has a sound controlling structure configured to control the resonance of sounds output from the speaker.

BRIEF DESCRIPTION OF THE DRAWINGS

The objects and features of the present invention will become more apparent from consideration of the following detailed description taken in conjunction with the accompanying drawings in which.

DETAILED DESCRIPTION OF THE PREFERRED EMBODIMENT

Figure 1:
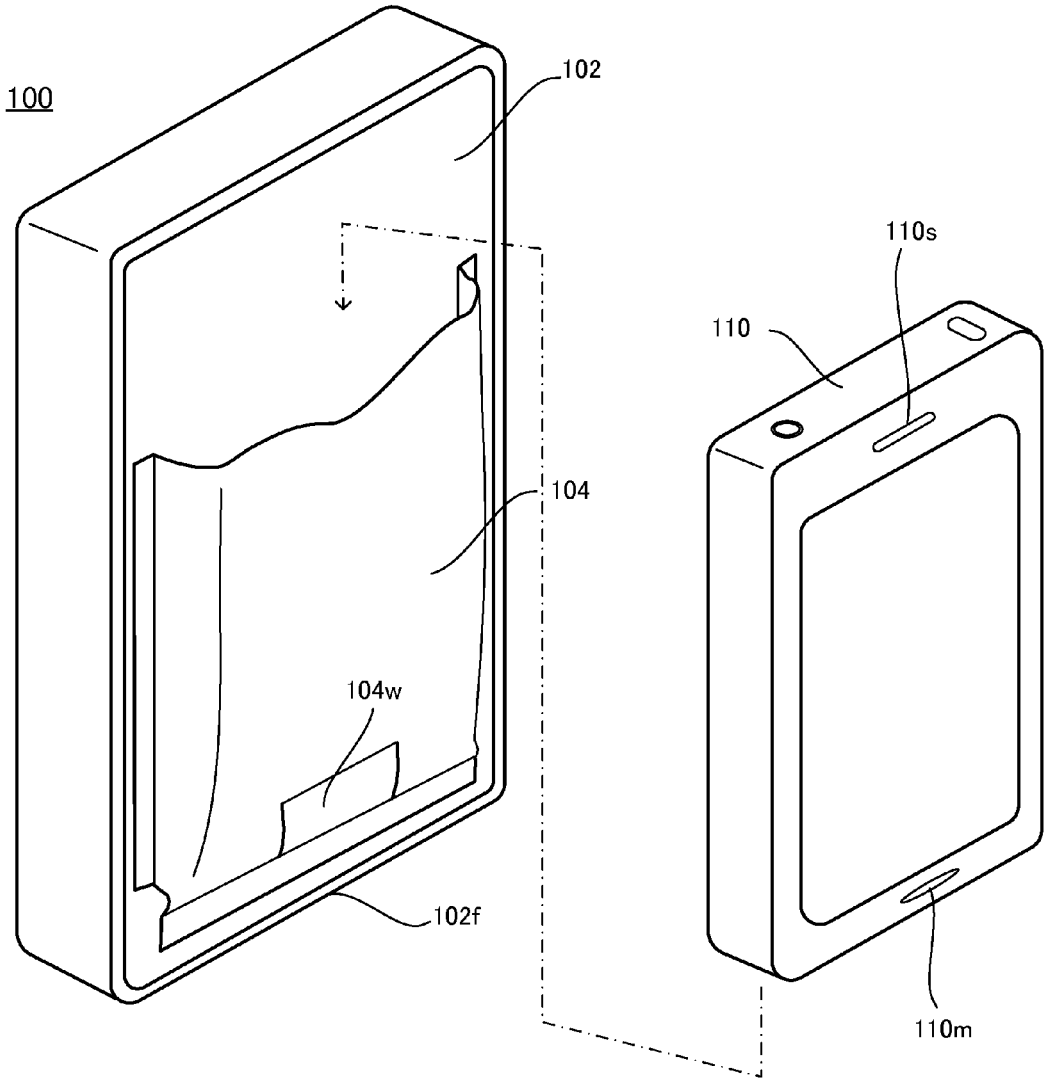
FIG. 1 is a perspective view for showing a sound control apparatus in accordance with an embodiment 1.

Referring now to the drawings, a sound control apparatus in accordance with the present invention will be explained. This sound control apparatus is capable of controlling the resonance of sound reproduced by a speaker. There are several characterizing features in the control of the resonance of sound (hereinafter referred to as sound control).

Examples of such sound controls include the absorption of high frequency components to make the resonance of sound more soft and more natural even in the case of small speakers which tend to emphasize high frequency components. In other words, high frequency components are inhibited from reflecting to improve transparency of sounds. Furthermore, the term "sound control" is used here to refer to the realization of desired sound propagation characteristics (i.e., sound improvement as actual feeling) in a sound environment by combining the sound control apparatus and an apparatus having a speaker such as a smartphone, a television or the like.

Embodiment 1

Figure 2:
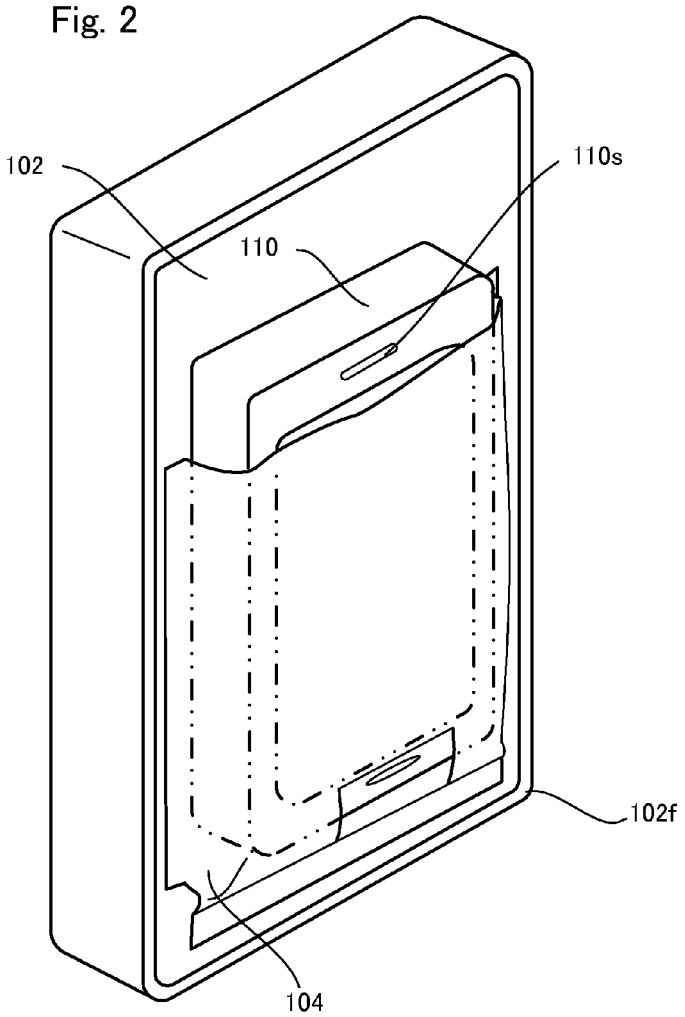
FIG. 2 is a perspective view for showing the sound control apparatus of the embodiment 1 on which a mobile terminal is mounted.

FIG. 1 is a perspective view for showing a sound control apparatus in accordance with the embodiment 1. As shown in FIG. 2, this sound control apparatus 100 consists of a sound control mat 102 with a pocket 104 into which is inserted a portable apparatus 110, for example, a mobile terminal having a communication capability such as a smartphone or a cellular phone, or any other portable device having no communication capability such as a digital music player. In other words, the pocket 104 serves as a support unit for supporting the portable apparatus 110 by the sound control apparatus.

The side surface of the sound control mat 102 is covered with a frame 102*f*. This frame 102*f* is provided for protecting the sound control mat 102 which is relatively fragile. On the other hand, the front and rear surfaces of the sound control mat 102 are exposed and opened to air. This is important in that unnecessary sound waves are inhibited from occurring. The pocket 104 of the portable apparatus 110 is sized to expose the speaker 110*s* of the portable apparatus 110. Furthermore, the pocket 104 is provided with an aperture 104*w* through which a recording microphone 110*m* of the portable apparatus 110 is exposed.

The sound control mat 102 is made of a sound control material in the form of a rectangle which is also a sound absorbing material and capable of substantially reducing the sound pressure in a high frequency range, for example no lower than 500 Hz, in which noisy sounds tend to occurring in the reproduction sounds output from a small-sized equipment such as a smartphone or a cellular phone. The acoustic characteristics of the sound control mat 102 are prepared (sound controlled) to have a sound controlling structure in order to maintain the important components of the reproduction sounds in a natural state for enjoying music. The details of this sound controlling structure and the mechanism of controlling sound resonance will be explained below.

Figure 3:
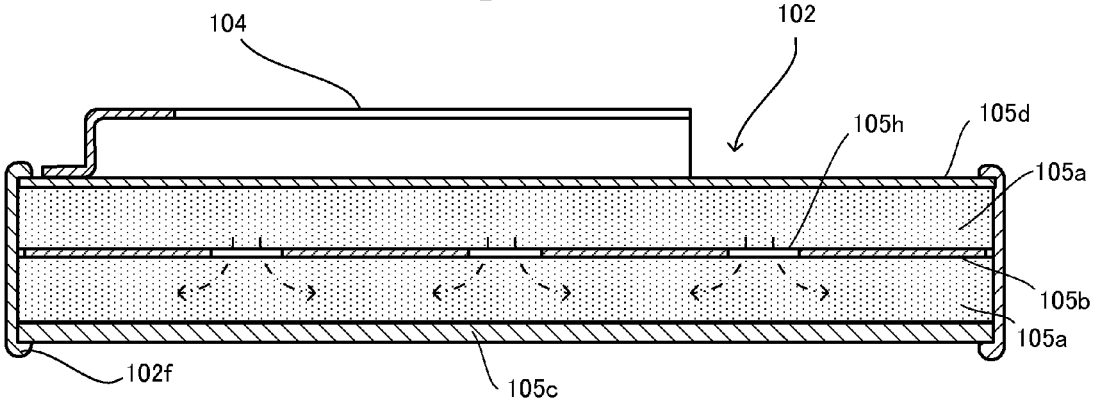
FIG. 3 is a cross sectional view for showing the structure of the sound control mat used in the sound control apparatus of the embodiment 1.

FIG. 3 is a cross sectional view for showing the structure of the sound control mat 102. The sound control mat 102 includes a pair of sound absorbing sheets 105*a* bonded as a laminate together with an intervening thin vinyl film 105*b* therebetween. The vinyl film 105*b* functions as a sound scattering. The sound absorbing sheet 105*a* is made of a needle felt which functions as a sound absorbing material. Other sound absorbing material which can be used for this purpose includes glass wool, thermo wool, bestray, softray, fibrous mineral wool and glass fiber, open-cell foam.

The thickness of the sound absorbing sheet 105*a* is for example 1 to 2 cm, and the thickness of the vinyl film 105*b* is for example 0.1 mm through 0.5 mm. Furthermore, the back side of the sound control mat 102 is covered by a soft polyvinyl chloride plate 105*c* for the purpose of supporting and protecting the sound control mat 102. Also, the other front side of the sound control mat 102 is covered by a cloth 105*d*. The total thickness of the sound control mat 102, the sound absorbing sheet 105*a*, the soft polyvinyl chloride plate 105*c* and the cloth 105*d* is thereby about 2 to 4 cm.

The sound controlling ability is generally improved as the vertical and lateral sizes of the sound control mat 102 increase. In this example, for use in smartphone use, the lateral size is from 12 cm to 15 cm, and the vertical size is from 18 cm to 25 cm. On the other hand, for use in tablet type terminals, the lateral size is from 15 cm to 20 cm, and the vertical size is from 25 cm to 30 cm.

Figure 4:
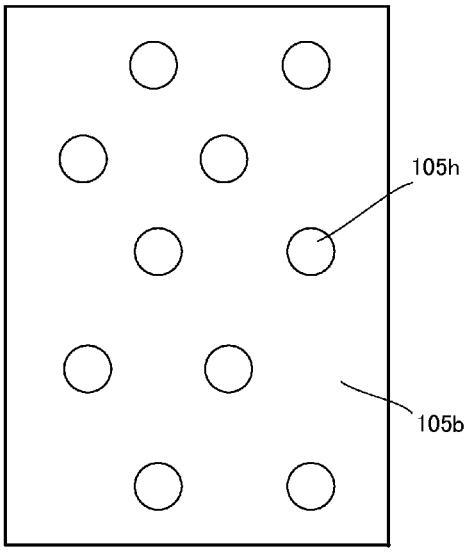
FIG. 4 is a plan view for showing a vinyl film which is inserted between sound absorbing sheets and through which a number of openings are formed.

FIG. 4 is a plan view for showing the vinyl film 105*b* which is inserted between the sound absorbing sheets 105*a* and through which a number of openings 105*h* are formed. For example, the diameter of each opening 105*h* is 2 cm, and adjacent ones thereof are located 7 cm distant from each other. With the openings 105*h*, the incident sound waves can be effectively scattered in the lateral direction to enhance the sound absorbing capabilities of the sound absorbing sheet 105*a*. In addition, the openings 105*h* allow part of the incident sound waves to pass through the vinyl film 105*b* to control the balance between reflection and transmission, such that they functions as a sound controlling means for controlling the resonance of reproduction sound.

The vinyl film 105*b* and the sound absorbing sheets 105*a* are joined with a viscous adhesive. The viscous adhesive is applied also between the sound absorbing sheets 105*a* through the openings 105*h*. While binding the vinyl film 105*b* and the sound absorbing sheets 105*a* together, this viscous adhesive maintains a certain viscosity. Also, while maintaining a certain viscosity, this viscous adhesive intervenes between the sound absorbing sheets 105*a* through the openings 105*h*. In other words, it is important that, when the the sound control mat 102 is used, the viscous adhesive shall not be solidified but can provide a glutinous layer between the vinyl film 105*b* and the sound absorbing sheets 105*a* and between the sound absorbing sheets 105*a*.

The reflection of sounds can be inhibited in a high frequency range by the adhesive which maintains its viscosity at the boundary between the sound absorbing sheets 105*a* to appropriately combine absorption and reflection of sounds through the entirety of the laminate and improve sound controlling effects. This sound absorbing structure is described in International Patent Published Application No. WO2012/137353A1.

When music is played with the portable apparatus 110, the resonance of sounds tends to be emphasized in a high frequency range because the housing thereof is too small to uniformly reproduce sounds in a high frequency range. However, the high frequency components can be absorbed by inserting the portable apparatus 110 into the pocket 104 of the sound control apparatus 100 as shown in FIG. 2 to suppress the resonance of sounds in a high frequency range.

It is possible in fact to easily distinguish the sounds of several musical instruments from sounds reproduced by a smartphone by the use of this sound control apparatus, in comparison with the case where the smartphone directly output sounds. Also, even when viewing a movie with the small volume, voices can easily be caught in a clearly audible state.

Furthermore, in accordance with the experiments conducted by the inventor, it was confirmed that the recording state could be improved by inserting the portable apparatus 110 into the pocket 104 of the sound control apparatus 100. That is to say, there are effects to reduce the noise components recorded together with the sounds to be recorded and the distortion component of the sound spectrum, and therefore the quality of the recorded sounds can be improved. This sound control apparatus is also effective in other fields. For example, in the case of speech recognition with the portable apparatus 110, it is possible to improve the recognition error rate by the use of the sound control apparatus 100.

The improvement of the recording state means that the sound control apparatus 100 can be used also to improve the environment for telephone conversation with a smartphone or the like. Namely, the quality of voice reproduced at the callee end can be improved by reducing the noise component of voices and the distortion component of the sound spectrum which are input to the microphone of the smartphone. Furthermore, the voice of the caller is not only transmitted to the callee but also reproduced at the caller end. The noise of the caller's voice superimposed on the callee's voice reproduced at the caller end can be suppressed by the use of the sound control apparatus 100, and therefore the caller can easily adjust the tone of voice. The environment of telephone conversation can therefore be expected to be further improved.

Figure 5:
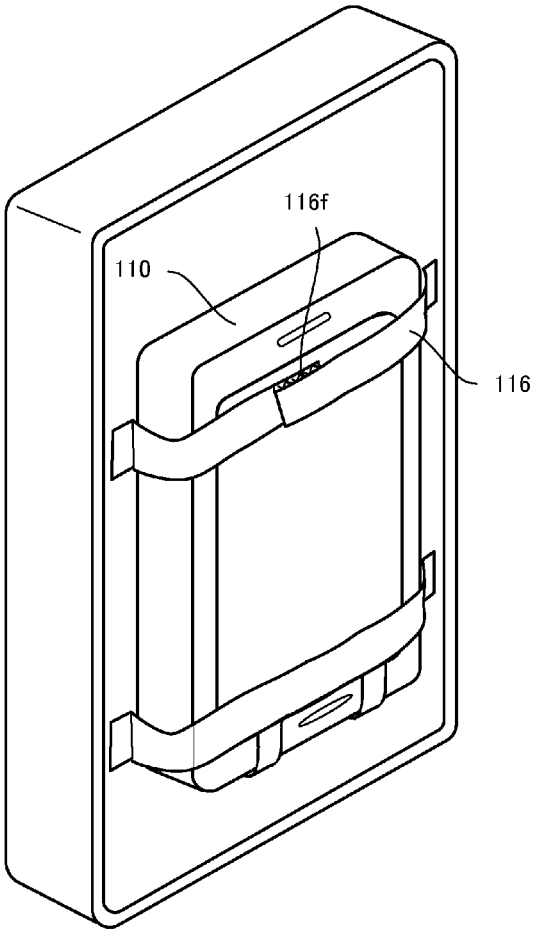
FIG. 5 is a perspective view for showing an alternative for a support unit for supporting a portable apparatus by the sound control apparatus of the embodiment 1.

Incidentally, the pocket 104 is made of a transparent vinyl film through which the screen of the portable apparatus 110 can be viewed. Alternatively, the pocket 104 can be made of a cloth or the like. Also, it is possible to hold the portable apparatus 110 only at upper and lower positions as illustrated in FIG. 5. In this case, a variety of portable apparatuses having different sizes can be held by making use of an upper belt 106 with a hook-and-loop fastener 106*f*.

Figure 6:
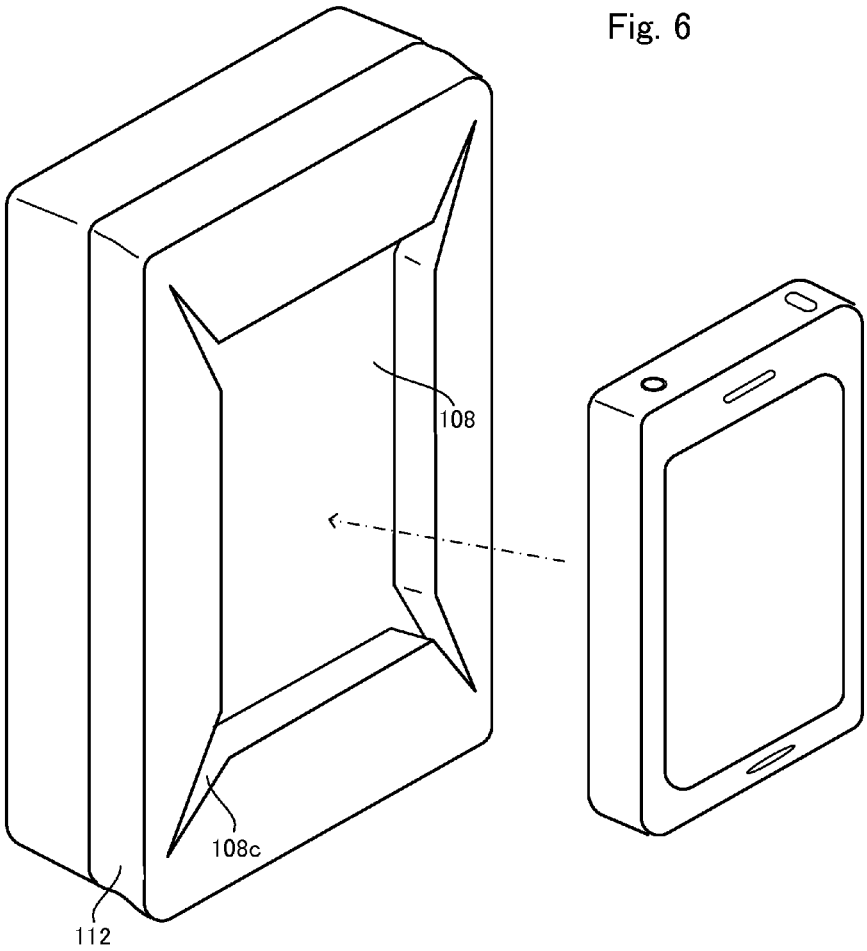
FIG. 6 is a perspective view for showing another alternative for a support unit for supporting a portable apparatus by the sound control apparatus of the embodiment 1.
Figure 7:
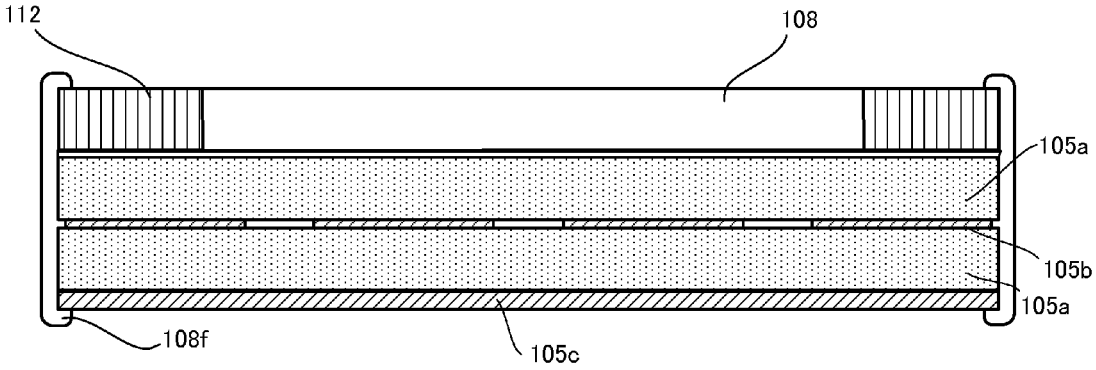
FIG. 7 is a cross sectional view for showing the support unit of FIG. 6.

Furthermore, as illustrated in FIG. 6 and FIG. 7, the front surface of the sound control mat 102 is covered with a sponge layer 112 having the same shape as the sound control mat 102. The sponge layer 112 is provided with the indent section 108 into which the portable apparatus 110 can be fitted. The depth of the indent section 108 is substantially same as that of the portable apparatus 110.

Figure 8:
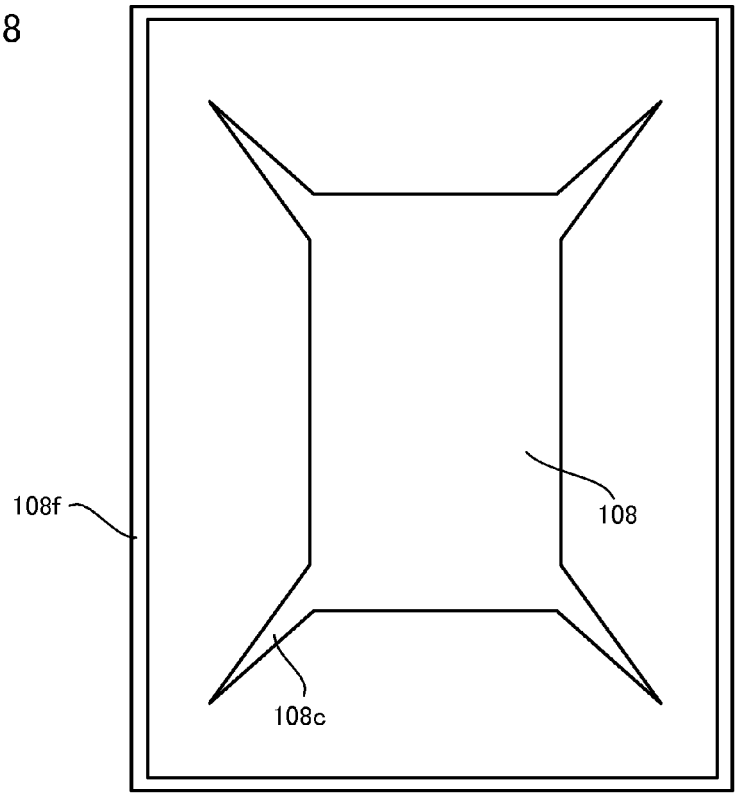
FIG. 8 is a plan view for showing the support unit of FIG. 6.
Figure 9:
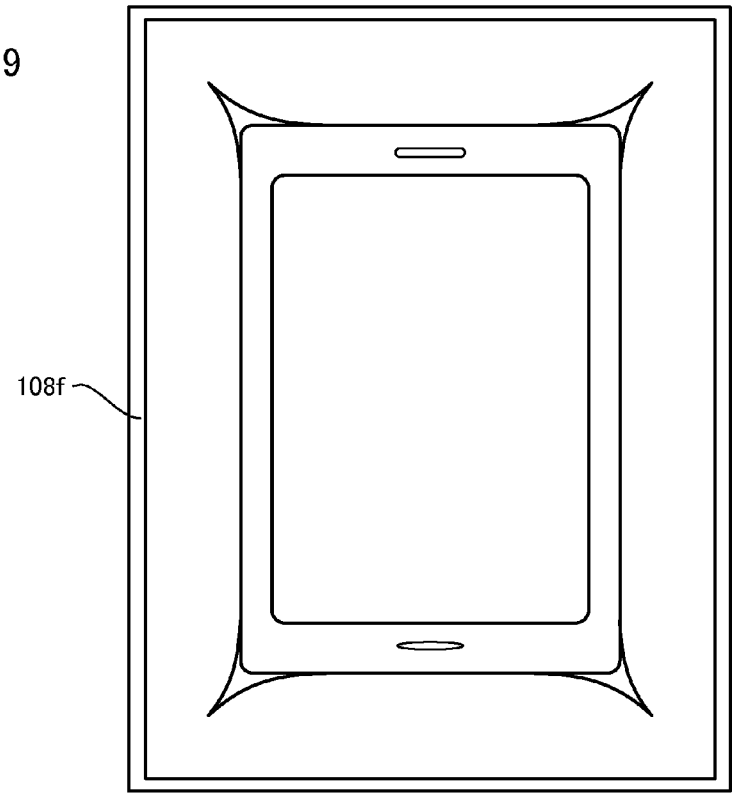
FIG. 9 is a plan view for showing the support unit of FIG. 6 on which a mobile terminal is mounted.
Figure 10:
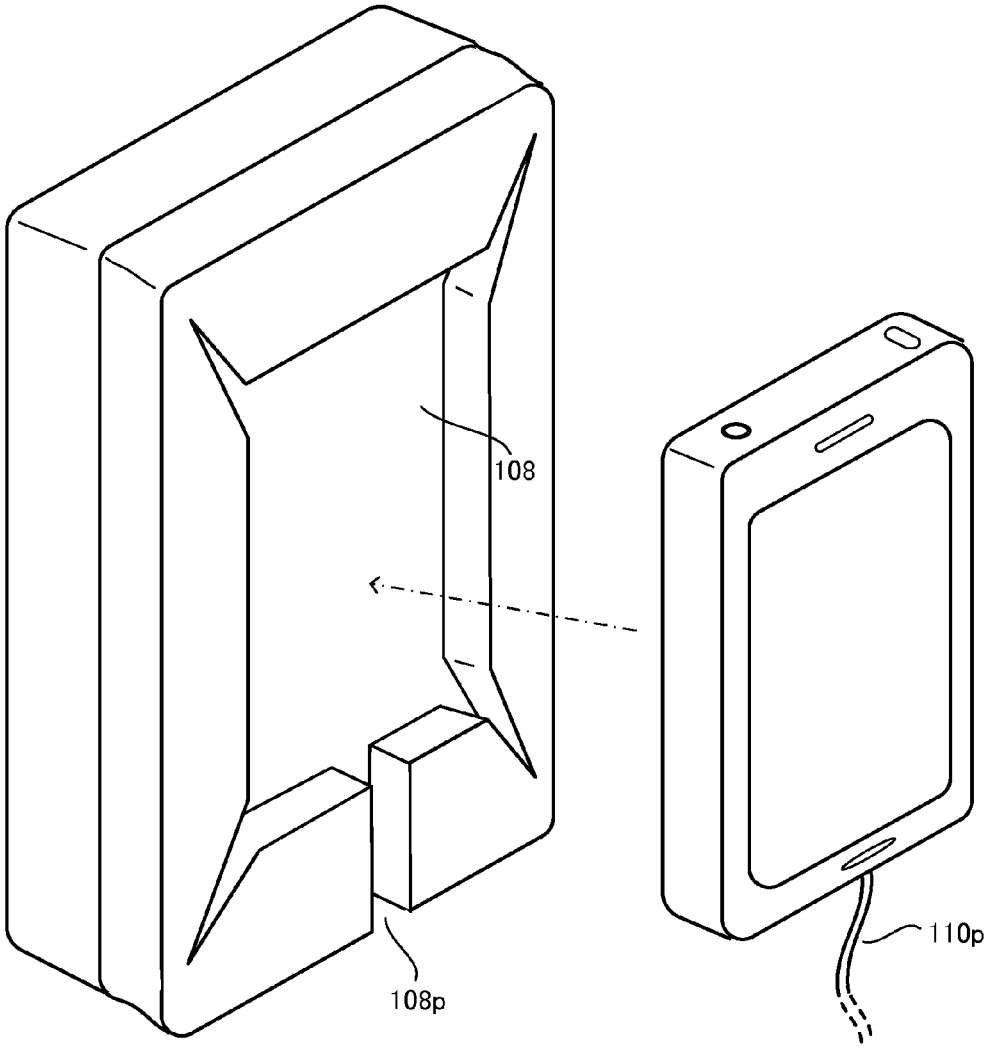
FIG. 10 is a perspective view for showing the sound control apparatus of FIG. 6 which is provided with a cut-out section for drawing out a cable of the portable apparatus.

In this case, as illustrated in FIG. 8 and FIG. 9, cut-out sections 108*c* are provided at the four corners of the indent section 108 so that the portable apparatus 110 can easily be inserted. These cut-out sections 108*c* absorb the difference in size of portable apparatuses and makes the sponge layer 112 to accept various types of the portable apparatus 110. Also, as illustrated in FIG. 10, another cut-out section 108*p* may be formed in order to draw out a cable 110*p* of the portable apparatus 110.

Although not shown in FIG. 6, the side surface of the sound control mat 102 is covered with a frame 108*f* corresponding to the frame 102*f* shown in FIG. 1. As shown in FIG. 7, the frame 108*f* covers the side surfaces of the sound control mat 102 and the sponge layer 112. In the case where the cut-out section 108*p* is formed as shown in FIG. 10, the frame 108*f* is also cut out corresponding to the cut-out section 108*p* to draw out the cable 110*p* of the portable apparatus 110.

Figure 11:
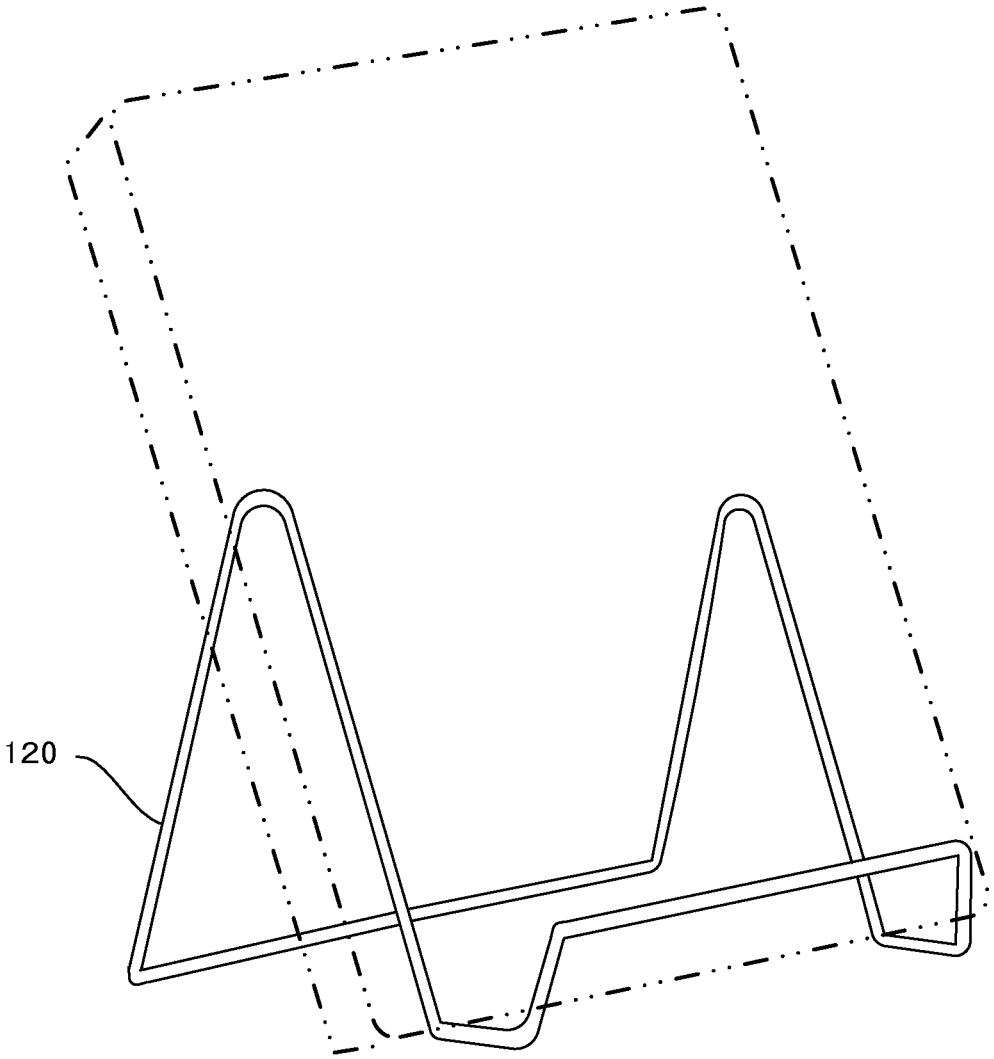
FIG. 11 is a perspective view for showing a stand on which the sound control apparatus of the embodiment 1 is supported.

The sound control apparatus 100 supporting the portable apparatus 110 may be laterally laid as it is, or obliquely rested on a wall or the like. Alternatively, as illustrated in FIG. 11, the portable apparatus 110 may be placed on a stand 120. Besides listening to music, this sound control apparatus can be used for a variety of purposes such as studying a foreign language, listening lectures for the entrance examination, playing a game or the like.

Embodiment 2

This embodiment differs from the embodiment 1 in the configuration of the frame for supporting the sound control mat 102.

Figure 12:
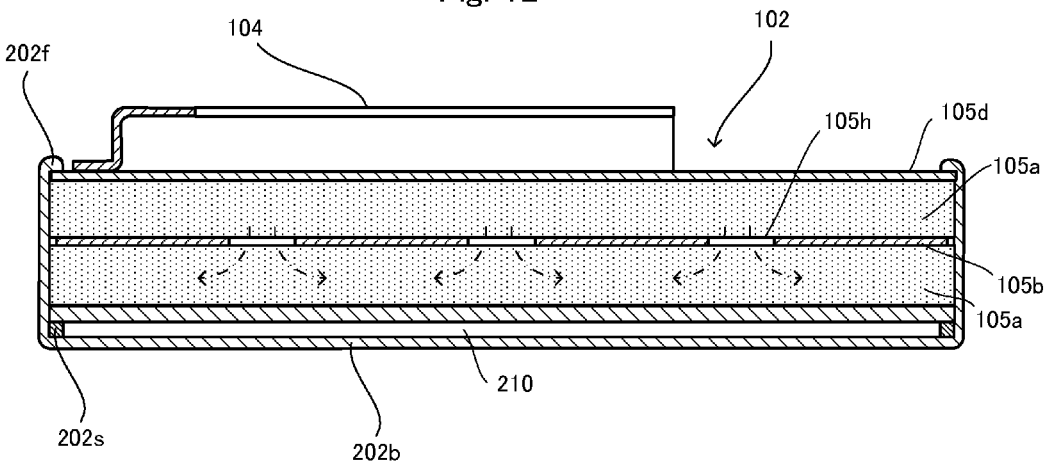
FIG. 12 is a cross sectional view for showing a sound control apparatus in accordance with the embodiment 2.

In what follows, this embodiment will be explained mainly with respect to the differences from the embodiment 1 without repeating redundant description. FIG. 12 is a cross sectional view for showing a sound control apparatus in accordance with the embodiment 2. As compared with the frame 102*f* of the sound control apparatus according to the embodiment 1, the frame 202*f* of this sound control apparatus is provided with a bottom portion 202*b* which is integrally formed with the side portions of the frame 102 and has the same area as the sound control mat 102, and a spacer 202*b* located around the inner bottom peripheral edge of the frame 102. The frame 202*f* of this sound control apparatus is thereby higher than the frame 102*f* of the embodiment 1. The spacer 202*b* separates the sound control mat 102 and the bottom portion 202*b* of the frame 202*f* to form an air layer 210 therebetween.

The air layer 210 can be thin as long as the sound control mat 102 is surely separated from the bottom portion 202*b* of the frame 202*f*. Specifically, 3 mm to 5 mm is enough as the thickness of the air layer 210 corresponding to the thickness of the spacer 202*b*. This structure is substantially effectively to reduce the resonance of unnecessary sounds in this sound control apparatus. Namely, high frequency sounds are repeatedly reflected through the air layer 210 and selectively reduced.

Figure 13:
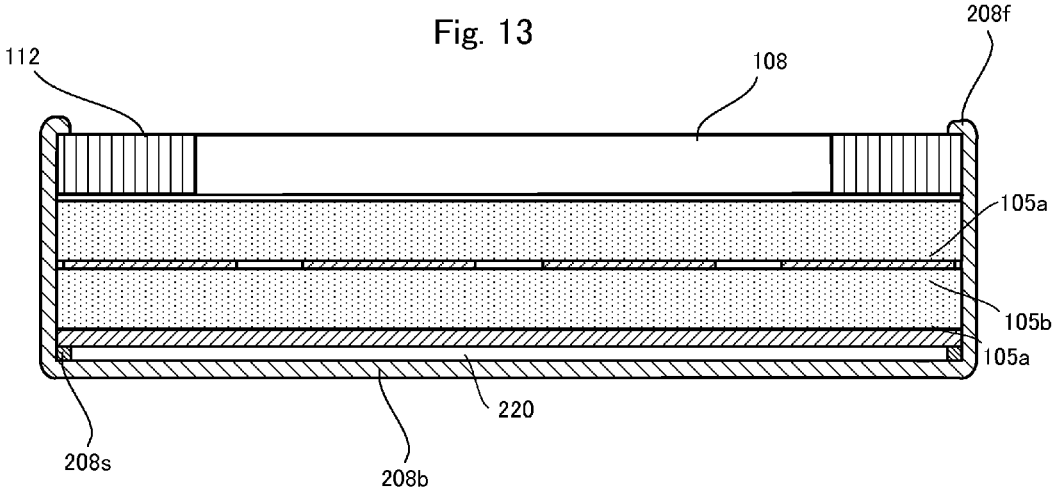
FIG. 13 is a cross sectional view for showing another example of the sound control apparatus in accordance with the embodiment 2.

FIG. 13 is a cross sectional view for showing another example of the sound control apparatus in accordance with the embodiment 2. This sound control apparatus shown in FIG. 13 corresponds to the sound control apparatus as illustrated in FIG. 6 and FIG. 7, but the frame 108*f* is replaced by a frame 208*f*. There is also an air layer 220 between the sound control mat 102 and the bottom portion 208*b* of the frame 208*f*. Likewise, the thickness of the air layer 220 is for example 3 mm to 5 mm corresponding to the thickness of the spacer 208*b*. Also, high frequency sounds are repeatedly reflected through the air layer 220 and selectively reduced.

Embodiment 3

This embodiment differs from the embodiment 1 in the configuration of the means for supporting a portable apparatus. In what follows, this embodiment will be explained mainly with respect to the differences from the embodiment 1 without repeating redundant description.

In accordance with the experiment by the inventor of the present invention, in comparison with the case where the sound control mat 102 is in direct contact with the portable apparatus 110, the sound profile became more clear, as actual feeling, when there was a space therebetween. The structure of the sound control apparatus according to the embodiment 3 is such that there is a space between the sound control mat 102 and the portable apparatus 110.

Figure 14:
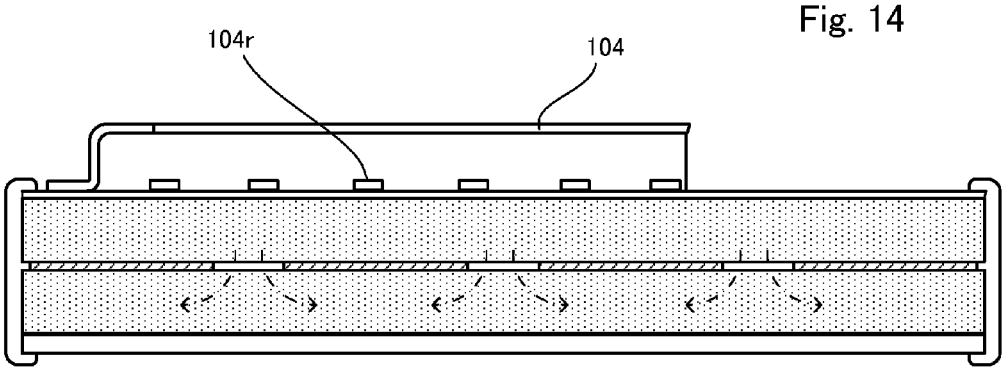
FIG. 14 is a cross sectional view for showing the sound control apparatus according to the embodiment 3 of the present invention.

FIG. 14 is a cross sectional view for showing the sound control apparatus according to the embodiment. A number of protrusions 104*r* are formed on the surface of the sound control mat 102 opposite to the inner surface of the pocket 104 as spacing members. Because of these protrusions 104*r*, when the portable apparatus 110 is inserted into the pocket 104, a space is formed between the sound control mat 102 and the portable apparatus 110.

Figure 15:
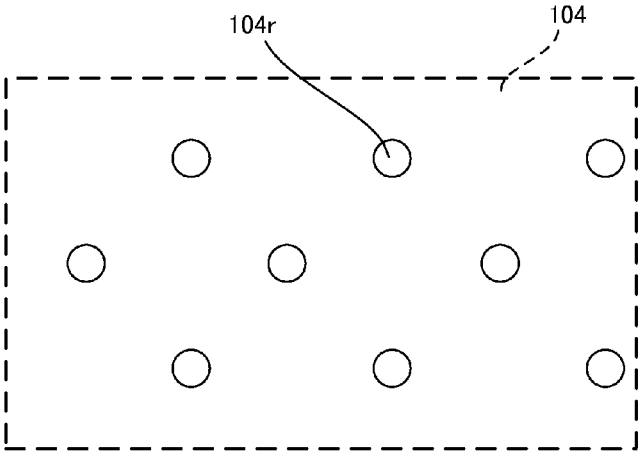
FIG. 15 is a plan view for showing a number of protrusions for providing a space between an electronic apparatus and the sound control mat of the sound control apparatus according to the embodiment 3.
Figure 16:
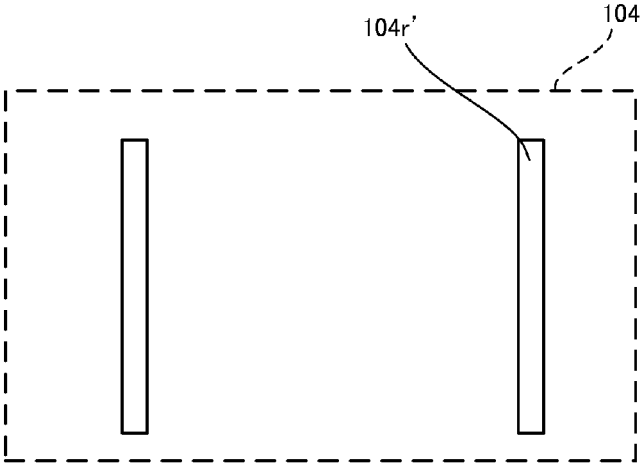
FIG. 16 is a plan view for showing an alternative for the protrusions for providing a space between an electronic apparatus and the sound control mat of the sound control apparatus according to the embodiment 3.
Figure 17:
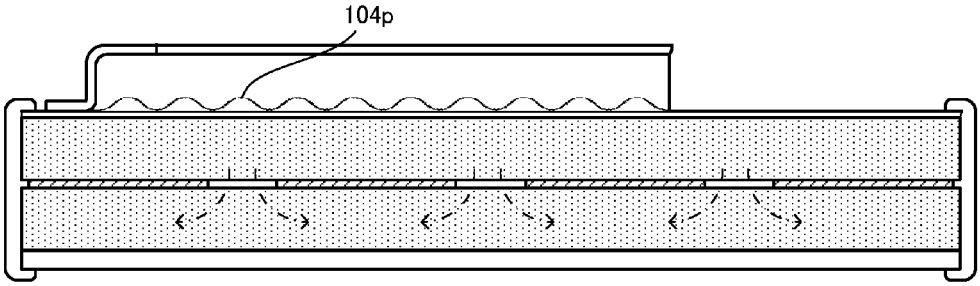
FIG. 17 is a cross sectional view for showing another alternative for the protrusions for providing a space between an electronic apparatus and the sound control mat of the sound control apparatus according to the embodiment 3.

These protrusions 104*r* are made, for example, of the same material as the vinyl film of the pocket 104 and laterally spaced from each other to support the portable apparatus 110 as illustrated in FIG. 15. Alternatively, as illustrated in a plan view of FIG. 16, two rectangular protrusions 104*r'* extending in the lateral direction may be used in place of the protrusions 104*r* in order to support the upper and lower (right and left in the figure) portions of the portable apparatus 110. Furthermore, as illustrated in a plan view of FIG. 17, a sponge layer 104*p* formed into a corrugated cross section may be attached to the surface of the sound control mat 102 as a spacing member in a location opposite to the inner surface of the pocket 104. The thickness (height) of each of these spacing members is 3 mm to 7 mm, for example 5 mm corresponding to the space to be formed.

Figure 18:
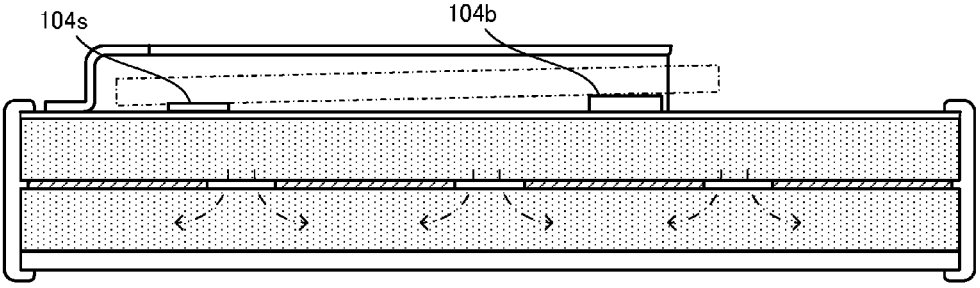
FIG. 18 is a cross sectional view for showing a modification of the protrusions for providing a space between an electronic apparatus and the sound control mat of the sound control apparatus according to the embodiment 3.
Figure 19:
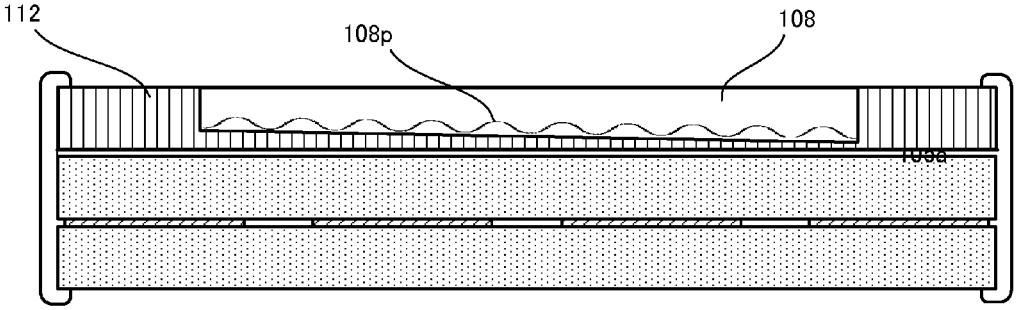
FIG. 19 is a cross sectional view for showing a further alternative for a support unit for supporting a portable apparatus by the sound control apparatus of the embodiment 3.

Also, as illustrated in FIG. 18, protrusions having different heights may be formed in order to support the upper and lower (right and left in the figure) portions of the portable apparatus 110. Typically, these different heights are provided in order that the speaker of the portable apparatus 110 is more separated from the sound control mat 102. In the case shown in FIG. 18, there are a thicker protrusion 104*b* and a thinner protrusion 104*s*. The thicker protrusion 104*b* is located closer to the speaker of the portable apparatus 110. Also, the indent section 108 of the sponge layer 112 shown in FIG. 6 may be provided with a bottom surface which is inclined and formed into a corrugated cross section as illustrated in FIG. 19.

By this configuration, there is a space for air intervening between the sound control mat 102 and the portable apparatus 110. This air space influences the reflection and interference of sound waves, and thereby serves as a means for controlling the resonance of sound to improve the quality of reproduction sound as actual feeling.

Figure 20:
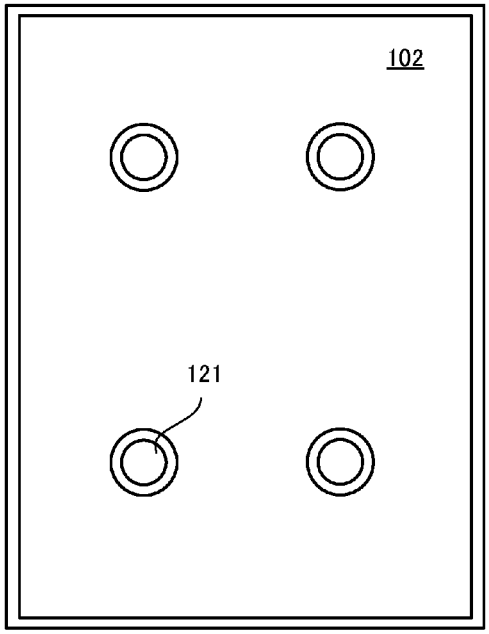
FIG. 20 is a plan view for showing a further alternative for a support unit for supporting a portable apparatus by the sound control apparatus of the embodiment 3.
Figure 21:
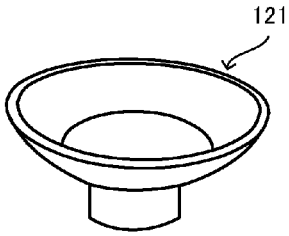
FIG. 21 is a perspective view for showing a small sucker or suction pad as a support unit for supporting a portable apparatus by the sound control apparatus of FIG. 20.
Figure 22:
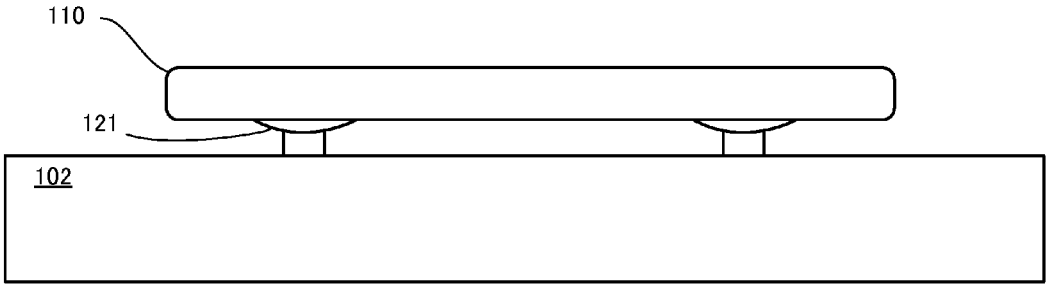
FIG. 22 is a plan view for showing the sound control apparatus of FIG. 20.

Furthermore, as illustrated in FIG. 20, a plurality of suckers or suction pads 121 may be mounted as spacing members on the surface of the sound control mat 102 used for the above embodiments. The diameter of the suckers 121 is, for example, 1 cm to 2 cm. In this case, the pocket 104 is dispensed with. The sound control apparatus can be used in an arbitrary place and an arbitrary posture by making use of such suckers 121 which stick to the bottom surface of the portable apparatus 110 as a support unit in place of the pocket 104. The sucker 121 may be a commercially available sucker made, for example, of polyvinyl chloride as illustrated in FIG. 21. Namely, as illustrated in FIG. 22, the portable apparatus 110 can be supported on the sound control mat 102 with an intervening space of 3 mm to 7 mm, for example 5 mm.

Figure 23:
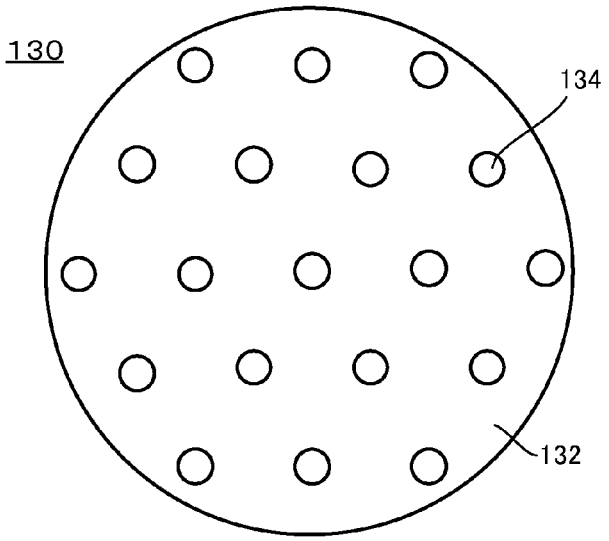
FIG. 23 is a plan view for showing a sound control apparatus provided with a means for providing a space between an electronic apparatus and the sound control mat of the sound control apparatus.
Figure 24:
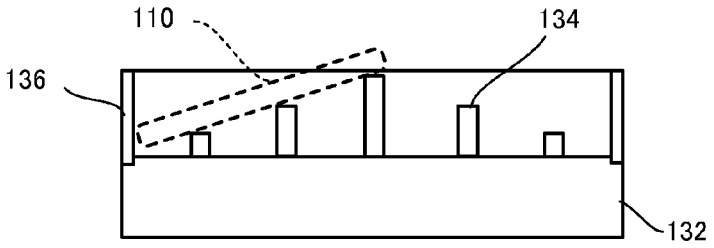
FIG. 24 is a cross sectional view for showing the sound control apparatus of FIG. 23.

Furthermore, in place of the above rectangular sound control mat 102, a cylindrical (circular) sound control mat 132 is used to construct a sound control apparatus 130 as shown in FIG. 23. A number of rods 134 are planted at equal intervals on the upper surface of the cylindrical sound control mat 132 as spacing members. These rods 134 are made of polyvinyl chloride in the form of long slender cylinders having a diameter of 5 mm as illustrated in FIG. 24. In addition to this, a cylindrical outer wall 136 made of ABS resin is provided outside the rods 134 on the cylindrical sound control mat 132.

Figure 25:
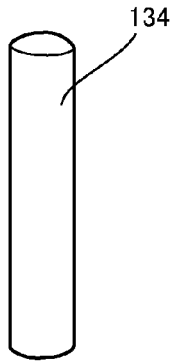
FIG. 25 is a perspective view for showing the means of FIG. 23 for providing a space between an electronic apparatus and the sound control mat.

The heights of the rods 134 are 2 cm at the center of the sound control mat 132 and decreases toward the edge as illustrated in FIG. 25. The rod 134 located closest to the cylindrical outer wall 136 has a height of 5 mm.

The cylindrical outer wall 136 has a radius of 10 cm and a height of 3 cm corresponding to the outer circumference of the sound control mat 132 as illustrated in FIG. 25. The portable apparatus 110 can be obliquely placed on this sound control apparatus 130 in order not to be slipped from the sound control apparatus 130 by the cylindrical outer wall 136.

Embodiment 4

Figure 26:
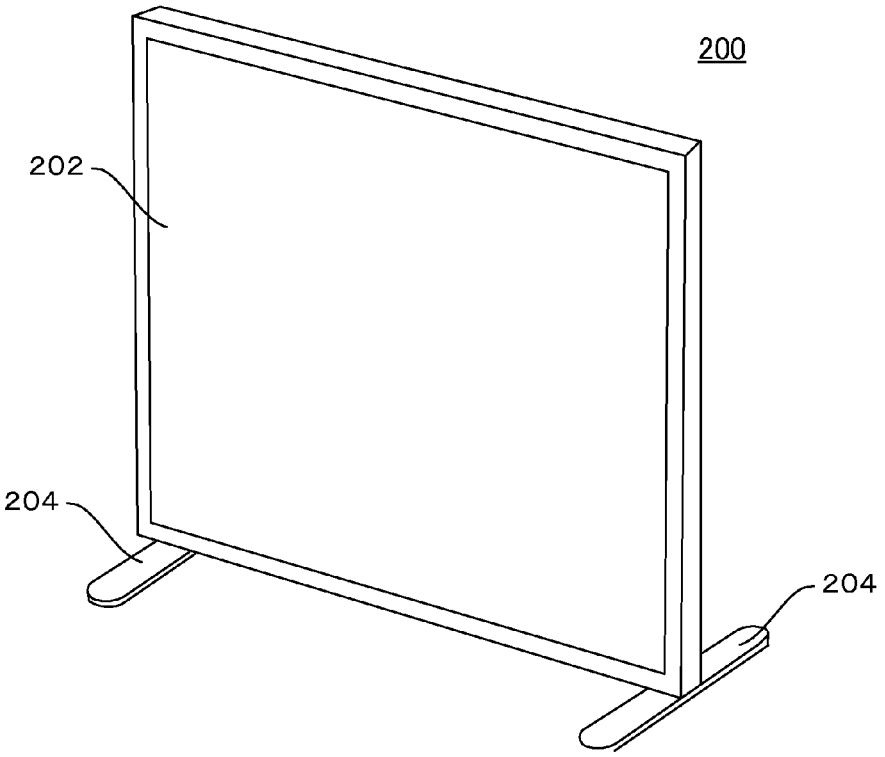
FIG. 26 is a perspective view for showing a sound control apparatus in accordance with the embodiment 4 of the present invention.

FIG. 26 is a perspective view for showing a sound control apparatus in accordance with the embodiment 4. This sound control apparatus 200 includes a sound control panel 202, and stands 204 which are support members for supporting this sound control panel 202 in an upright position. This sound control panel 202 is made mainly of a sound control material which is substantially same as used for the sound control mat 102 of the embodiment 1 except for the size.

The sound control apparatus 200 has an excellent sound absorbing ability to provide significant auditory effects as if the space is opened through the sound control panel. Accordingly, even in a small room, it is possible to enjoy a deep auditory sensation with the sound control apparatus 200 placed behind a speaker.

Figure 27:
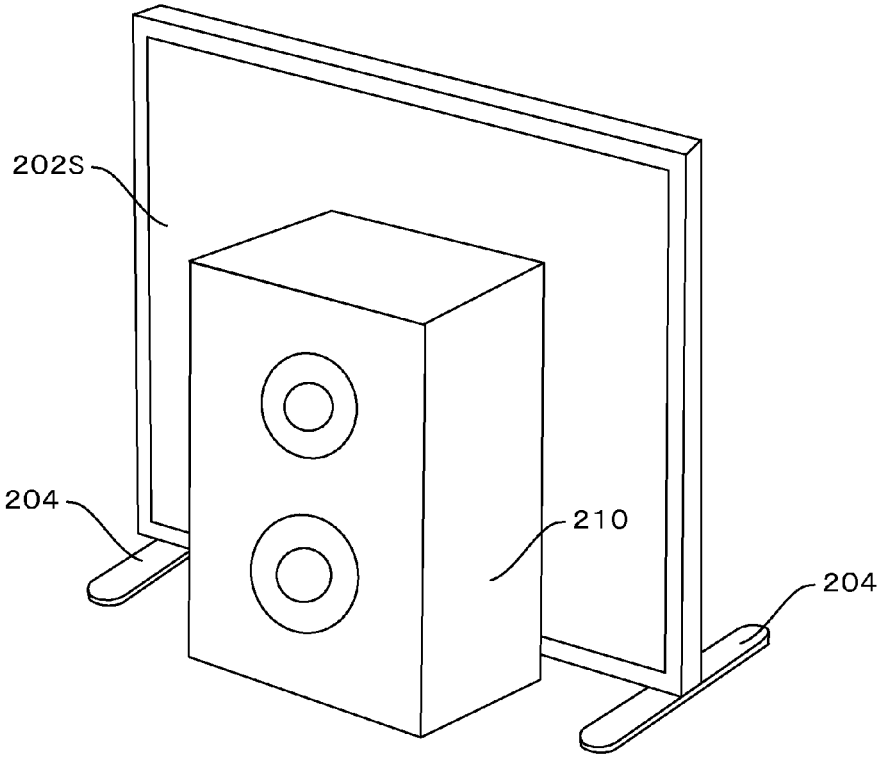
FIG. 27 is a perspective view for showing the sound control apparatus of the embodiment 4 of the present invention which is being used.
Figure 28:
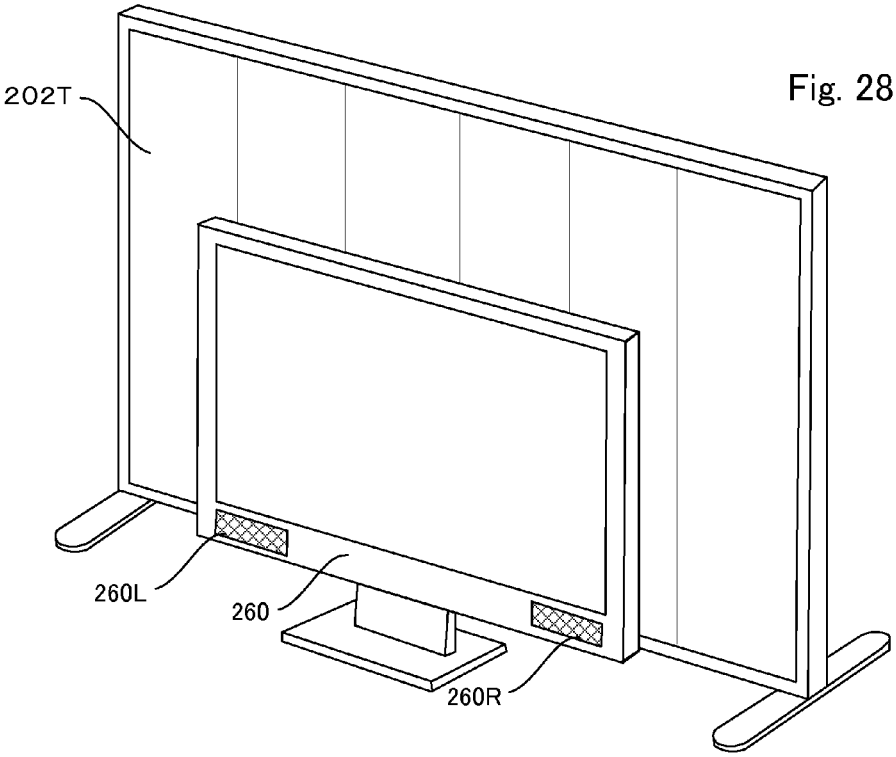
FIG. 28 is a perspective view for showing another example of the sound control apparatus of the embodiment 4 of the present invention which is being used.

For example, the sound control apparatus 200 can be placed behind a speaker 210 of a stereo system as shown in FIG. 27, or behind a television 260 as shown in FIG. 28. In the case where the sound control apparatus 200 is used with the stereo system, for example, the sound control panel 202S is 1.5 times to twice larger than the speaker 210 both in the vertical and lateral directions.

On the other hand, in the case where the sound control apparatus 200 is used with the television 260, for example, the size of the sound control panel 202S is 1.5 times to twice the distance between the right and left edges of the right and left speakers 260L and 260R respectively both in the vertical and lateral directions. Usually, the sound control panel 202 is 1.5 times to twice wider than the television video signal 260. For example, for a 40-inch television, a suitable size sound of the sound control panel 202 is from 60 inches to 80 inches.

Embodiment 5

Figure 29:
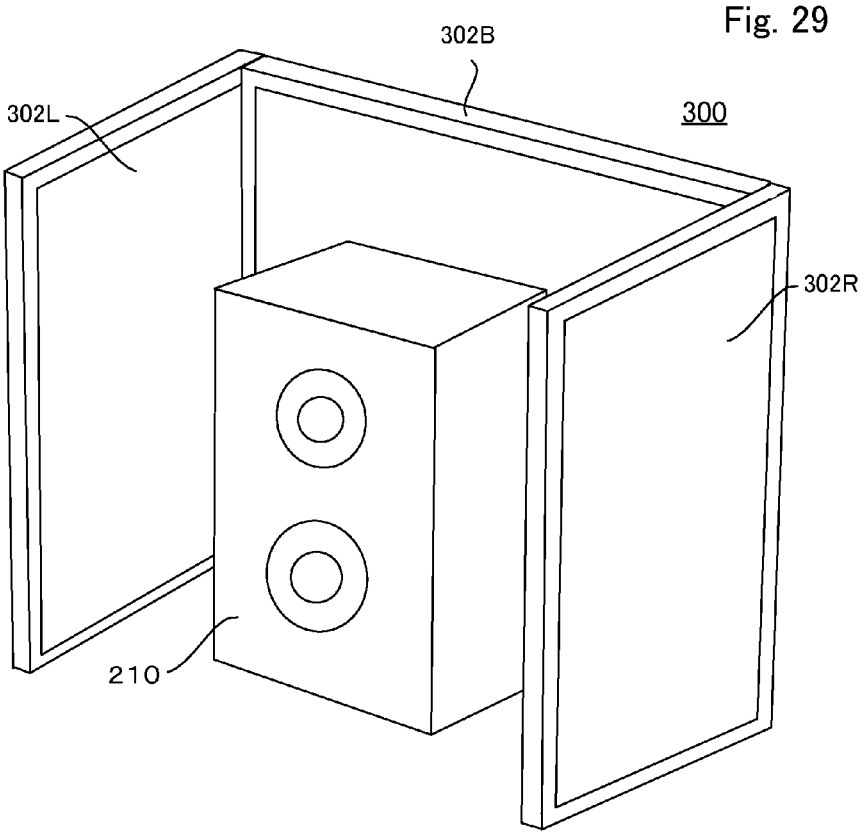
FIG. 29 is a perspective view for showing a sound control apparatus which is being used in accordance with the embodiment 5.

FIG. 29 is a perspective view for showing a sound control apparatus in accordance with the embodiment 5. This sound control apparatus 300 is configured to cover not only the back but also the sides of the speaker 210. Namely, this sound control apparatus 300 consists of three sound control panels, i.e., a rear panel 302B, a left panel 302L and a right panel 302R which are made of the same material as the sound control panel 202 of the embodiment 4.

The rear panel 302B is slightly smaller than the sound control panel 202 of the embodiment 1, i.e., 1.3 times to 1.2 times larger than the speaker 210 both in the vertical and lateral directions. This is because the sound control is performed also by the left panel 302L and the right panel 302R in the lateral direction. Each of the left panel 302L and the right panel 302R may be substantially the same size (depth) as the speaker 210.

Figure 30:
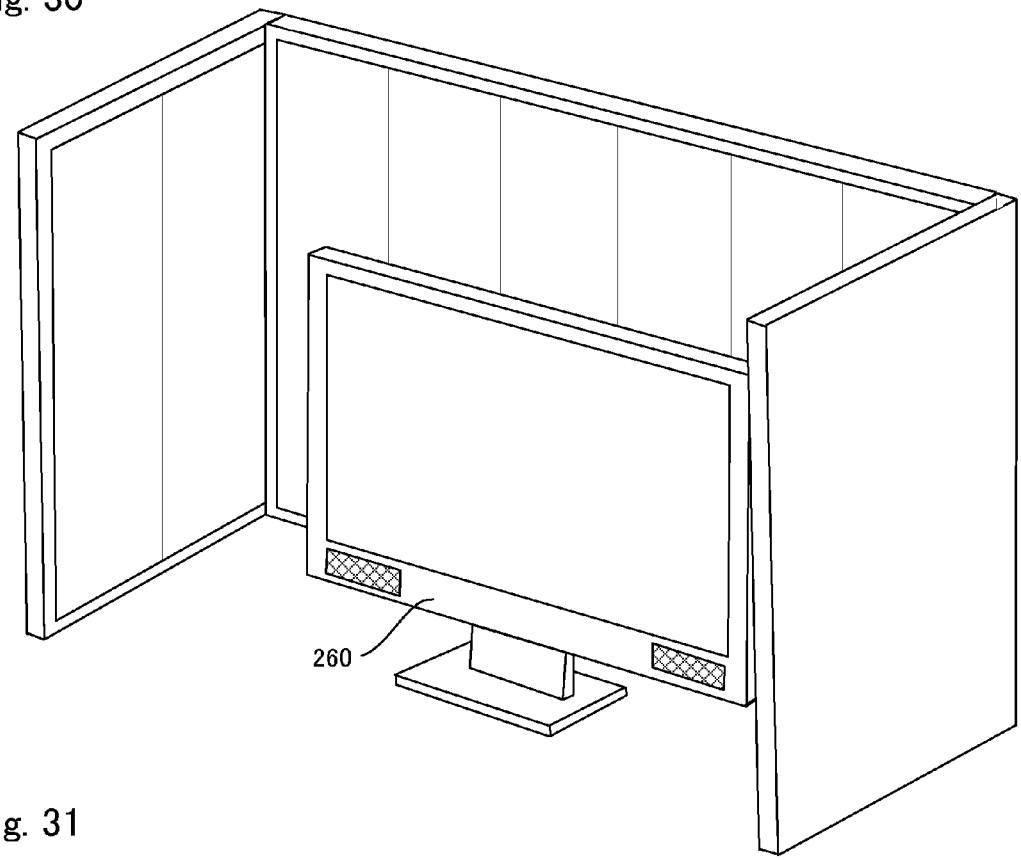
FIG. 30 is a perspective view for showing another example of the sound control apparatus in accordance with the embodiment 5 which is being used.
Figure 31:
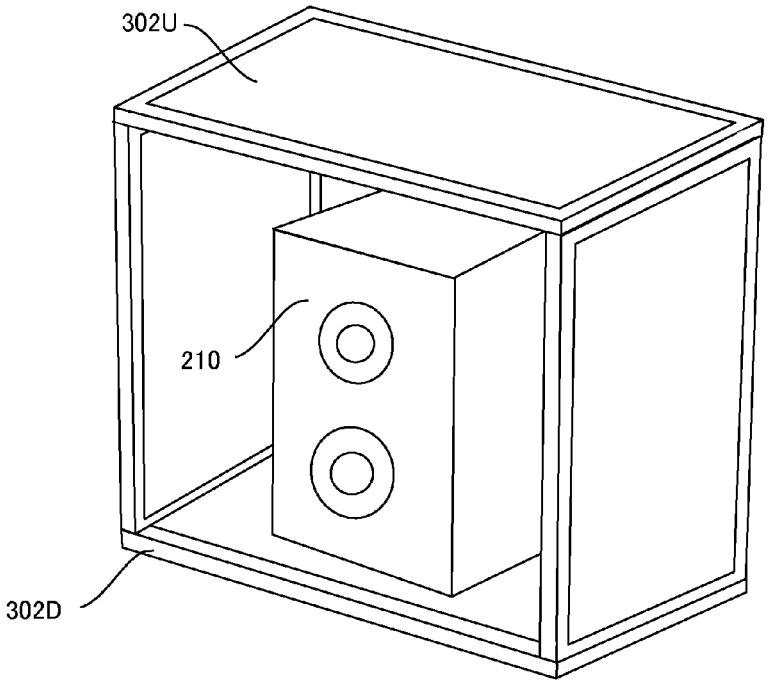
FIG. 31 is a perspective view for showing a modification of the sound control apparatus in accordance with the embodiment 5.

As illustrated in FIG. 30, the sound control apparatus of the embodiment 4 may be resized to fit the television 260 to cover the back and sides thereof and improve the resonance of sound output from the television 260. Furthermore, as illustrated in FIG. 31, an upper panel 302U and a lower panel 302D may be added in the form of a box to vertically cover the speaker 210.

In accordance with the sound control apparatus of the present invention, it is possible to improve the quality of reproduction sound output from the speaker of the portable apparatus 110 such as a smartphone, and enjoy a good tone of music and the like without the use of a headphone.

Also, the present invention is not limited to the portable apparatus as described above, but applicable to any type of electronic apparatus incorporating a small size speaker, such as wristwatch type terminals, cameras, small size video recorders, radio receivers, digital music players, IC recorders, projectors for improving the quality of reproduction sound.

Furthermore, in accordance with the sound control apparatus of the present invention, it is possible to improve the quality of sounds recorded through a recording microphone of a smartphone or the like. In the case of speech recognition with an electronic apparatus supported by the sound control apparatus in accordance with the present invention, it is possible to lower the recognition error rate.

Still further, in accordance with the sound control apparatus of the present invention, it is possible to enjoy a good tone output from a television and a stereo system without needing a special devising.

The foregoing description has been presented on the basis of the image forming apparatus and the image processing method according to the embodiments of the present invention. However, it is not intended to limit the present invention to the precise form described, and obviously many modifications and variations are possible within the scope of the invention.

Figure 32:
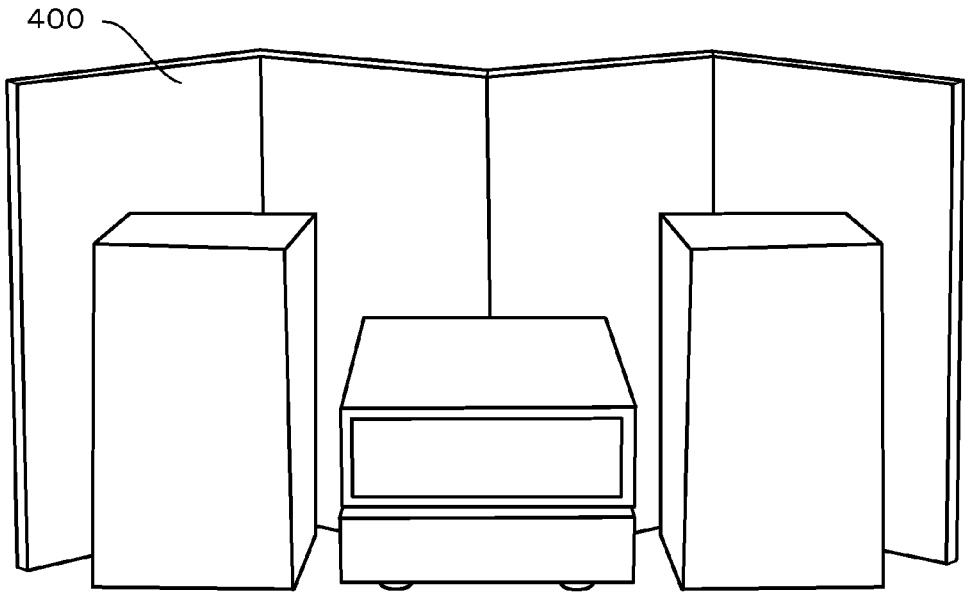
FIG. 32 is a perspective view for showing another modification of the sound control apparatus in accordance with the embodiment 5.

For example, as illustrated in FIG. 32, a plurality of sound control panels 400 may be connected with hinges and assembled in the form of folding screens. In this case, even if sounds are reflected on the sound control panels 400 placed behind a stereo system, the reflected sounds are laterally diverted to realize a deeper auditory sensation.

What is claimed is:

1. A sound control apparatus comprising:

a sound control mat;

a frame configured to cover a side surface of the sound control mat;

a support unit configured to support an electronic apparatus having a speaker on the sound control mat; and a frame configured to cover a side surface of the sound control mat, wherein the sound control mat has a sound controlling structure configured to control the resonance of sound output from the speaker of such electronic apparatus when such apparatus is supported by the sound control mat, and wherein the frame is provided with a bottom portion having substantially the same area as the sound control mat, and a spacer located on the bottom surface of the frame that forms a space between the sound control mat and the bottom surface of the frame.

2. The sound control apparatus of claim 1, wherein the support unit comprises a sponge layer which is formed on the surface of the sound control mat with an indent section having a smaller size than the electronic apparatus to be supported on the mat such that such electronic apparatus can be inserted in and supported by the indent section.

3. The sound control apparatus of claim 1, wherein the electronic apparatus is a wristwatch type terminal, a camera, a small size video recorder, a radio receiver, a digital music player, an IC recorder, or a projector.

4. The sound control apparatus of claim 1, wherein the sound control mat comprises at least one of needle felt, bestray, softray, glass wool, thermo wool, phenol resin, polyurethane, fibrous mineral wool, glass fiber and open-cell foam.

5. The sound control apparatus of claim 1, wherein the sound control mat comprises a plurality of sound absorbing sheets joined together with an adhesive in the form of a laminate.

6. The sound control apparatus of claim 5, wherein the adhesive comprises a viscous adhesive which does not solidify after formation of the laminate, maintains its viscosity when a mobile terminal booth is used, and functions as the sound controlling structure.

7. The sound control apparatus of claim 5, wherein the laminate comprises a resin sheet interposed between each adjacent ones of the sound absorbing sheets.

8. The sound control apparatus of claim 7, wherein the resin sheet has a thickness of 0.1 mm to 0.5 mm.

9. The sound control apparatus of claim 7, wherein the resin sheet is provided with a plurality of openings, and wherein the sound absorbing sheets are directly adhered to each other by the adhesive through the openings, and indirectly adhered to each other by the adhesive through the resin sheet.

10. The sound control apparatus of claim 1, further comprising a spacing member configured to provide a space between the sound control mat and an electronic apparatus, when such electronic apparatus is supported by the sound control mat.

11. The sound control apparatus of claim 10, wherein a plurality of suction pads comprise the spacing member on a surface of the sound control mat.

12. The sound control apparatus of claim 1, wherein the sound control mat is shaped in a cylindrical form, wherein the spacing member is provided as a number of rods which are projected upward from a surface of the sound control mat, and wherein the rods are longest at a center of the sound control mat and gradually become shorter toward an outer circumference of the sound control mat.

13. The sound control apparatus of claim 10, wherein the sound control mat and such electronic apparatus are spaced by a distance of 3 mm to 7 mm when such electronic apparatus is supported by the sound control mat.

14. The sound control apparatus of claim 3, further comprising said sound absorbing mat comprising a plurality of sound absorbing sheets joined together with an adhesive in the form of a laminate, and a frame configured to cover the side surface of the laminate.

15. The sound control apparatus of claim 4, wherein the frame is configured to cover only the side surface of the laminate of the sound absorbing sheets, and front and back surfaces of the laminate are open to air.

* * * * *